US005522473A

United States Patent [19]

Moselsky

[11] Patent Number: 5,522,473

[45] Date of Patent: Jun. 4, 1996

[54] LADDER STABILIZING DEVICE

[76] Inventor: William Moselsky, 280 Mary Webb Rd., Windsor, Conn. 06096

[21] Appl. No.: 371,360

[22] Filed: Jan. 11, 1995

[51] Int. Cl.[6] ..... E06C 7/44

[52] U.S. Cl. ..... 182/204; 182/111

[58] Field of Search ..... 182/200–205, 182/107–3, 111

[56] References Cited

U.S. PATENT DOCUMENTS

| | | | |
|---|---|---|---|
| 1,431,068 | 10/1922 | Waney | 182/109 |
| 1,455,002 | 5/1923 | Johnson . | |
| 2,196,640 | 4/1940 | Meier | 228/64 |
| 2,620,115 | 12/1952 | Guldjord | 182/109 |
| 4,243,122 | 1/1981 | Coutts | 182/200 |
| 5,107,958 | 4/1992 | Johnson | 182/204 |

FOREIGN PATENT DOCUMENTS

| | | | |
|---|---|---|---|
| 2303152 | 5/1976 | France | 182/200 |
| 118340 | 3/1927 | Switzerland | 182/111 |

*Primary Examiner*—Alvin C. Chin-Shue
*Attorney, Agent, or Firm*—McCormick, Paulding & Huber

[57] ABSTRACT

A ladder stabilizing device for attached to the lower end of a ladder rail. The device is incrementally adjustable to compensate for irregularities in a ladder supporting surface and has a support base including spaced apart front and rear legs to provide sound footing for the ladder. The support base is pivotal between a ladder supporting position and a storage position.

21 Claims, 2 Drawing Sheets

LADDER STABILIZING DEVICE

BACKGROUND OF THE INVENTION

This invention relates in general to ladder safety devices and deals more particularly with an improved stabilizing device for a ground-supported straight ladder.

A ground supported ladder of the type with which the present invention is concerned is used in an inclined position with its upper end portion resting on or against a suitable support. When a downwardly directed force is applied to the ladder by someone standing on it there is a nature tendency for the base of the ladder to move in a horizontal direction away from the supporting surface. Most serious accidents involving ladders of this type can be attributed to failure to provide a sound ladder footing. Long straight ladders and particularly extension ladders are inherently unstable when supported on uneven ground. When such a ladder is used on irregular or sloping surfaces it is common practice to block or shim the ladder to compensate for the irregularity of the supporting surface. This is an extremely dangerous practice, but in many instances the practice cannot be avoided. This is particularly true where there is no provision for adjusting the effective length of the ladder side rails.

Accordingly, it is the general aim of the present invention to provide an improved ladder stabilizing device which is geometrically designed to provide a wide support base to assure firm footing for a straight ladder. It is a further aim of the invention to provide a ladder stabilizing device which may be readily adjusted to compensate for irregularities in the ladder supporting surface and may be collapsed to a storage position for convenient handling and storage.

SUMMARY OF THE INVENTION

In accordance with the present invention, a stabilizing device is provided for a straight ladder having elongate parallel laterally spaced apart side rails including upper and lower ends and a plurality of spaced apart rungs extending laterally between and connecting the side rails. Such a ladder is normally arranged in a forwardly and upwardly inclined position with the upper end portion resting on a supporting structure. The stabilizing device comprises a base member having an upwardly extending front leg and an upwardly extending rear leg spaced from the front leg. The base member further includes a forwardly and upwardly inclined carrying member which is connected to and extends between the upper ends of the rear leg and the front leg. An elongate support member is mounted on the base member for pivotal movement about a laterally extending axis relative to the base member and carries a connecting member which defines a socket for receiving the lower end of an associated side rail. A means is provided for releasably securing the associated side rail to the connecting member.

DETAILED DESCRIPTION OF PREFERRED EMBODIMENT

Figure 1:
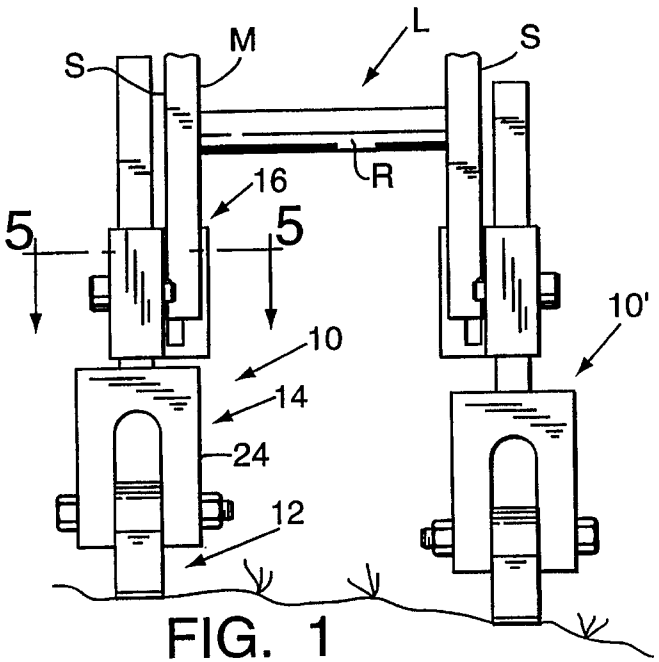
FIG. 1 is a fragmentary front elevational view of a straight ladder shown supported on an uneven surface by a pair of stabilizing devices embodying the present invention.

Turning now to the drawing and referring first to FIG. 1 a pair of ladder stabilizing devices embodying the present invention and indicated generally at 10 and 10' are shown attached to and supporting a straight ladder designated generally by the letter L. The illustrated ladder L is a conventional extension ladder and has a main section M which includes a pair of elongate parallel laterally spaced apart side rails S, S. The side rails have upper and lower ends, but only the lower ends are shown. A plurality of longitudinally spaced apart rungs R, R extend laterally between and connect the side rails S, S. The illustrated ladder L is an extension ladder and also includes an extendible section (not shown) which is generally telescopically engaged with the main section M. The ladder L is adapted for use in a forwardly and upwardly inclined position with the upper end portion of the ladder resting upon a suitable supporting structure (not shown). The stabilizing devices 10, 10' are adjustable and particularly adapted to support a ladder, such as the ladder L, in a stable position both on a level supporting surface and on uneven ground, as shown in FIG. 1 and as will be hereinafter evident from the further description which follows.

The illustrated ladder stabilizing devices 10 and 10' are preferable fabricated from a light weight metal, such as aluminum, and are substantially identical to each other, but of opposite hand for a reason which will be hereinafter evident.

Figure 4:
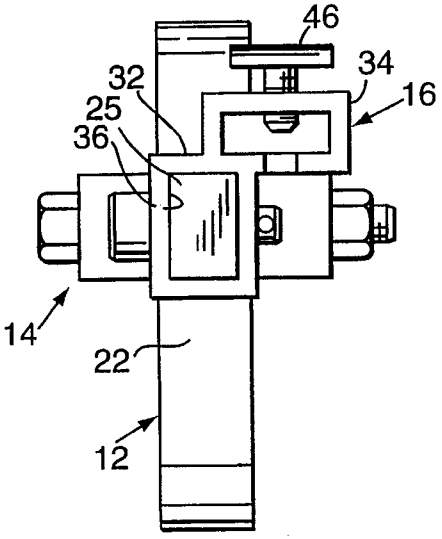
FIG. 4 is a fragmentary top plan view of the device shown in FIG. 2.
Figure 2:
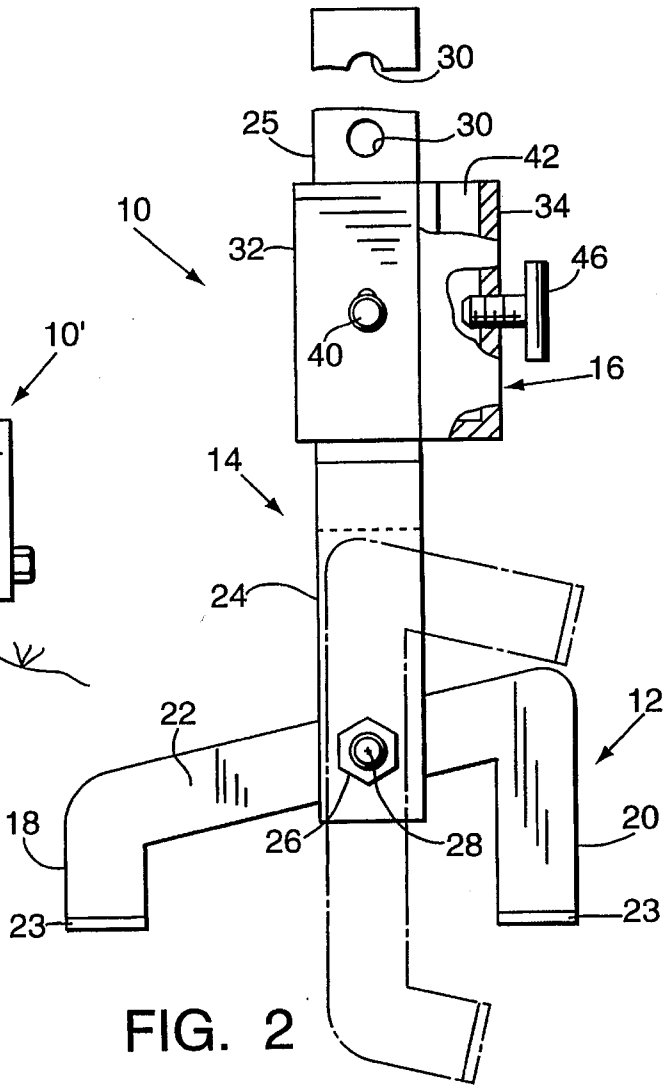
FIG. 2 is a somewhat enlarged fragmentary side elevational view of a ladder stabilizing device embodying the present invention.
Figure 3:
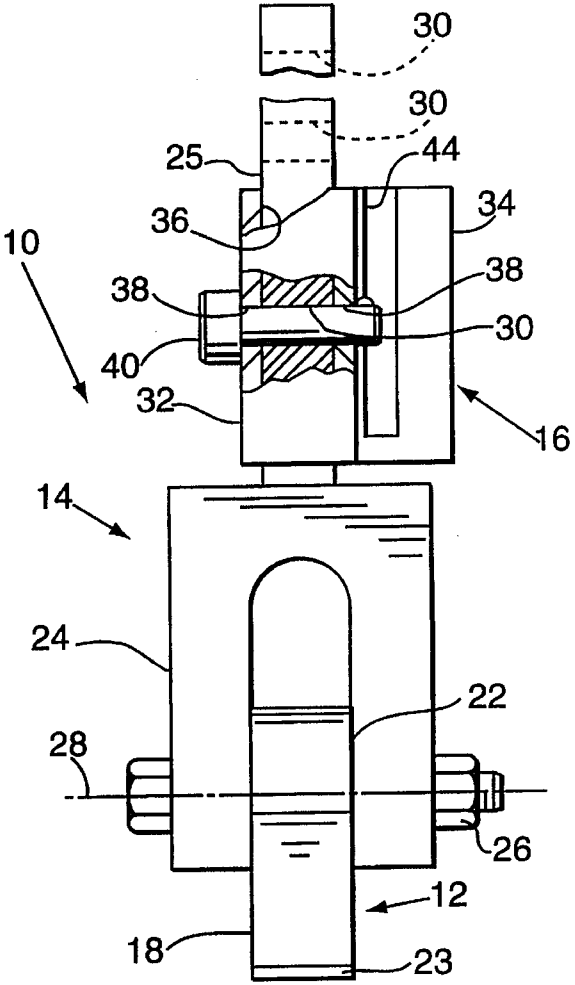
FIG. 3 is a fragmentary front elevational view of the device.

Further referring to the drawings and particularly to FIGS. 2–4, the left hand device 10 is illustrated and essentially comprises a base member indicated generally by the numeral 12, a support member pivotally mounted on the base member and designated generally by the numeral 14 and a connecting member indicated generally at 16 and adjustably secured to the support member 14.

Considering the ladder stabilizing device 10 in further detail, the base member 12 comprises a unitary structure and includes an upwardly extending rear leg 18 and an upwardly extending front leg 20, which is somewhat longer than the rear leg, and a forwardly and upwardly inclined carrying member 22 integrally connected to and extending between the upper ends of the rear leg 18 and the front leg 20. Preferably and as shown the legs 18 and 20 have friction pads 23, 23 attached to the bottom surfaces thereof, as best shown in FIGS. 2 and 4.

The support member 14 has a longitudinally upwardly extending elongate shank 25 and a bifurcated lower end portion or clevis 24 which straddles the carrying member 22. The lower end portion of the support member 14 is pivotally connected to the carrying member 22 by a pivot pin or bolt 26 which extends laterally through both the bifurcated lower end portion 24 and the carrying member 22. Preferably, and as best shown in FIG. 2, the axis of the pivot pin 26, indicated at 28, is located closer to the front leg 20 than to the rear leg 18. A series of longitudinally spaced apart cylindrical holes 30, 30 extend transversely through the upwardly extending shank 25 for a purpose which will be hereinafter further evident.

Figure 5:
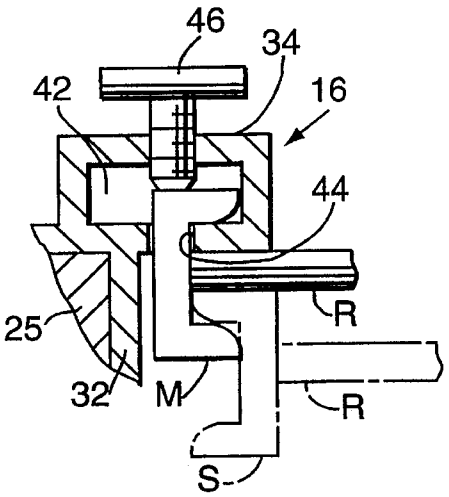
FIG. 5 is a somewhat enlarged fragmentary sectional view taken along the line 5—5 of FIG. 1.

The connecting member 16 is slidably supported on the shank 25 and is formed as either a right or left handed part, as shown in FIG. 1. It has a generally rectangular collar portion 32 and a socket defining portion 34 which is both laterally and rearwardly offset relative to the collar portion 32, as best shown in FIGS. 3 and 5. The collar portion 32 has a rectangular bore 36 extending through it which receives and substantially complements the shank 25 on the support member 14. Laterally aligned cylindrical holes 38, 38 substantially equal in size to the holes 30, 30 open through opposite sides of the collar portion 32 for registry with a selected one of the holes 30, 30 to receive a locking pin 40 for releasably securing the collar in a selected one of a plurality of incremental positions of adjustment along the shank 25. The locking pin may take various forms. However, the illustrated locking pin 40 includes a spring ball detent at its free end for releasably retaining the pin in assembly with the collar 34.

The socket defining portion 34 includes an upwardly open blind socket 42 partially defined by a slot 44 in the front wall of the socket defining portion 34. The socket has a generally T-shaped cross-section as viewed from above (FIGS. 3 and 5) and is particularly adapted to receive the lower end of a metal ladder having side rails S, S of channel shaped cross-section. A clamping fastener 46 threadably engaged in the rear wall of the socket defining portion 34 for clampingly engaging the lower end portion of a ladder sidewall S to releasably retain the device 10 in assembly with the ladder.

In FIG. 5 the lower end of a side rail of the extension ladder L is shown clamped within the socket 42, the extendible portion of the ladder being shown in broken lines. When the device 10 is attached to a ladder of the type shown the extendible portion of the ladder may be moved to its fully lowered position without removing the device from the ladder. It is for this reason that the socket defining portion is offset relative to the collar portion 32. The geometry of the base member 12 and the manner in which the support member 14 is connected to the base member provide a sound support base for the ladder L.

The support base 12 is pivotally moveable between an active position wherein the carrying member 22 extends generally transversely of the support member 14 and a storage position wherein the carrying member is disposed in generally axially parallel relation to the support member, as it appears in broken lines in FIG. 2.

Figure 6:
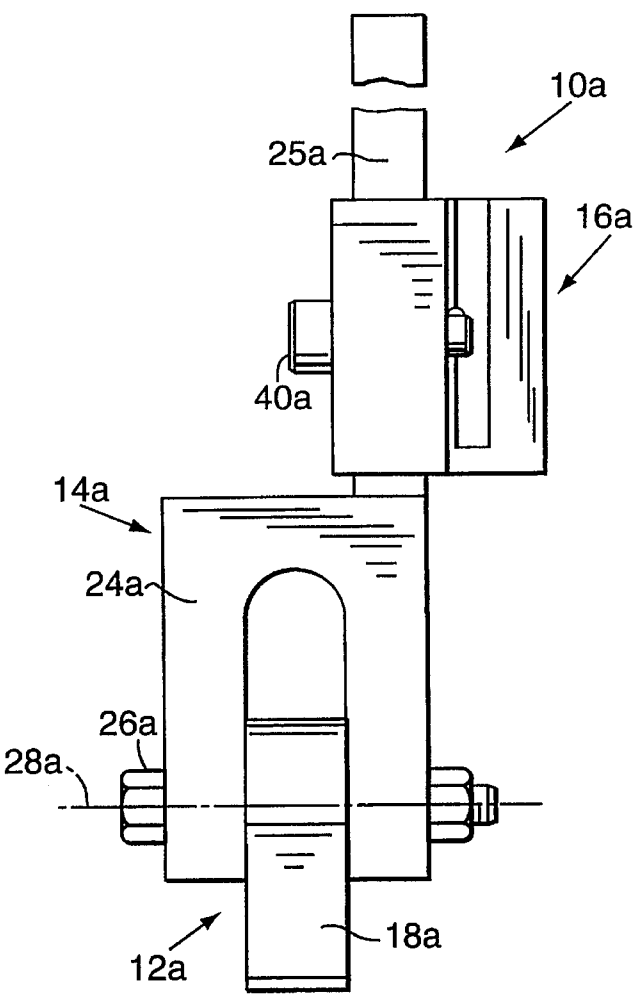
FIG. 6 is a fragmentary front elevational view of another ladder stabilizing device embodying the present invention.

FIG. 6 illustrates another ladder stabilizing device embodying the present invention and indicated generally at **10*a*. The illustrated device 10*a* is similar in most respects to the device 10** previously described and parts which correspond to parts of the previously described device bear the same reference numeral and a letter a suffix and will not be hereinafter described in detail.

The device **10*a* differs from the device 10 in the construction and arrangement of the support member 14*a*. Specifically, the support member 14*a* has an upwardly extending shank portion 25*a* which carries the connecting member 16*a*, as previously described. The support member 14*a* also has a bifurcated lower end portion indicated at 24*a* which is laterally offset relative to the shank portion 25*a***.

The ladder stabilizing device **10*a*, which comprises the presently preferred structure, is used in combination with a substantially identical ladder stabling device of opposite hand to support a straight ladder in the manner hereinbefore described. However, because of the laterally offset arrangement of the base members 12** the devices provide a somewhat wider support base for a ladder and provide a greater degree of lateral stability.

I claim:

1. A stabilizing device for a straight ladder having elongate parallel laterally spaced apart side rails including upper and lower end portions and a plurality of longitudinally spaced apart rungs extending laterally between and connecting said side rails, the ladder being adapted for use in a forwardly and upwardly inclined position with its upper end portion resting upon a supporting structure, said stabilizing device comprising a base member having an upwardly extending front leg and an upwardly extending rear leg spaced from said front leg, said front leg being substantially longer than said rear leg, a forwardly and upwardly inclined carrying member connected to and extending between the upper ends of said rear leg and said front leg, an elongate support member mounted on said base member for pivotal movement about a laterally extending axis and relative to said base member, a connecting member mounted on said support member and having a socket defining portion laterally and rearwardly offset relative to said support member for receiving the lower end portion of an associated side rail, and securing means for releasably attaching said connecting member to the associated side rail.

2. A stabilizing device for a straight ladder as set forth in claim 1 wherein said support member has an upwardly extending shank portion and said bifurcated lower end portion is laterally offset relative to said shank portion.

3. A stabilizing device for a straight ladder having elongate parallel laterally spaced apart side rails including upper and lower end portions and a plurality of longitudinally spaced apart rungs extending laterally between and connecting said side rails, the ladder being adapted for use in a forwardly and upwardly inclined position with its upper end portion resting upon a supporting structure, said stabilizing device comprising a base member having an upwardly extending front leg and an upwardly extending rear leg spaced from said front leg, a carrying member connected to and extending between the upper ends of said rear leg and said front leg, an elongate support member having an upwardly extending shank portion and a bifurcated lower end portion laterally offset relative to said shank portion and straddling said carrying member, a pivot pin extending through said bifurcated lower end portion and said carrying member and mounting said support member on said base member for pivotal movement about a laterally extending axis and relative to said base member, and connecting means mounted on said support member for releasably securing said support member to an associated side rail of a straight ladder.

4. A stabilizing device for a straight ladder as set forth in claim 3 wherein said connecting means comprises a connecting member slidably supported on said support member and defining a socket for receiving the lower end portion of an associated ladder side rail.

5. A stabilizing device for a straight ladder as set forth in claim 3 wherein said front leg is substantially longer than said rear leg, said carrying member is forwardly and upwardly inclined, and said axis is located closer to said front leg than to said rear leg.

6. A stabilizing device for a straight ladder as set forth in claim 3 wherein said axis is located closer to said front leg than to said rear leg.

7. A stabilizing device for a straight ladder as set forth in claim 4 wherein said socket defining portion of said connecting member is laterally offset relative to said support member.

8. A stabilizing device for a straight ladder as set forth in claim 7 wherein said socket defining portion is rearwardly offset relative to said support member.

9. A stabilizing device for a straight ladder as set forth in claim 3 wherein said connecting means comprise a connecting member mounted on said support member for adjustable positioning along said support member and said device includes retaining means for releasably securing said connecting member in a selected position of adjustment relative to said support member.

10. A stabilizing device for a straight ladder as set forth in claim 9 wherein said connecting member is incrementally adjustable relative to said support member and said retaining means comprises a retaining pin received within apertures in said connecting member and said support member.

11. A stabilizing device for a straight ladder as set forth in claim 3 wherein said base member is pivotally moveable relative to said support member between an active position wherein said carrying member is disposed with its longitudinal axis extending in a generally transverse direction relative to the longitudinal axis of said support member and a storage position wherein the longitudinal axis of said carrying member is generally axially parallel to the longitudinal axis of said support member.

12. A stabilizing device for a straight ladder as set forth in claim 9 wherein said securing means comprises a clamping fastener threadably engaged with said connecting member.

13. A stabilizing device for a straight ladder as set forth in claim 4 wherein said connecting member includes a front wall having a slot therethrough defining a portion of said socket.

14. A stabilizing device as set forth in claim 12 wherein said socket has a generally T-shaped cross-section.

15. A stabilizing device for a straight ladder as set forth in claim 14 wherein said socket defined by said connecting member is rearwardly and laterally offset relative to said support member.

16. A stabilizing device for a straight ladder having elongate parallel laterally spaced apart side rails including upper and lower end portions and a plurality of longitudinally spaced apart rungs extending laterally between and connecting said side rails, the ladder being adapted for use in a forwardly and upwardly inclined position with its upper end portion resting upon a supporting structure, said stabilizing device comprising a base member having an upwardly extending rear leg, an upwardly extending front leg having a greater length than said rear leg and spaced forwardly of said rear leg, and a forwardly and upwardly inclined carrying member integrally connected to and extending between the upper ends of said rear leg and said front leg, an elongate longitudinally extending support member having a bifurcated lower end portion straddling said carrying member, a pivot pin extending through said bifurcated lower end portion and said carrying member and securing said support member to said base member for pivotal movement about a laterally extending axis and relative to said base member, a connecting member mounted on said supporting member for sliding movement longitudinally of said supporting member between a plurality of positions of adjustment relative to said supporting member, said connecting member defining a socket laterally and rearwardly offset relative to said support member for receiving the lower end of an associated one of the side rails therein, retaining means for releasably securing said connecting member in a selected position of adjustment relative to said support member, and means for releasably securing said connecting member to the associated one of the side rails.

17. A stabilizing device for a straight ladder as set forth in claim 16 wherein said connecting member includes a front wall portion and said socket is partially defined by a longitudinally extending slot opening through said front wall portion.

18. A stabilizing device for a straight ladder as set forth in claim 17 wherein said socket has a generally T-shaped cross-section.

19. A stabilizing device for a straight ladder as set forth in claim 16 wherein said base member is supported for pivotal movement relative to said support member between an active position wherein said carrying member is disposed in transverse relationship to said support member and a storage position wherein said carrying member is disposed in generally parallel relation to said support member.

20. A stabilizing device for a straight ladder as set forth in claim 16 wherein said retaining means comprises a clamping fastener threadably engaging said connecting member for clampingly engaging the lower end of an associated one of the side rails received within said socket.

21. A stabilizing device for a straight ladder as set forth in claim 16 wherein said support member has an upwardly extending shank, said connecting member is mounted on said shank, and said bifurcated lower end portion is laterally offset relative to said shank.

* * * * *